United States Patent [19]

Ayers et al.

[11] Patent Number: 4,801,910

[45] Date of Patent: Jan. 31, 1989

[54] MAGNETIC ACTUATING MECHANISM

[75] Inventors: Curtis J. Ayers, Lithonia; Janerio N Morgan, Atlanta; William E. May, Lawrenceville, all of Ga.

[73] Assignee: Siemens Energy and Automation, Inc., Atlanta, Ga.

[21] Appl. No.: 154,778

[22] Filed: Feb. 10, 1988

[51] Int. Cl.[4] ..... H01F 7/08

[52] U.S. Cl. ..... 335/230; 335/174; 335/186

[58] Field of Search ..... 335/170, 174, 175, 186, 335/229, 230, 234

[56] References Cited

U.S. PATENT DOCUMENTS

| | | | |
|---|---|---|---|
| 2,536,740 | 1/1951 | Haddad | 320/33 |
| 2,759,062 | 8/1956 | O'Neill | 200/87 |
| 2,841,669 | 7/1958 | Cook | 200/102 |
| 2,916,584 | 12/1959 | Molyneux | 200/104 |
| 2,919,324 | 12/1959 | Schuessler | 200/93 |
| 3,022,450 | 2/1962 | Chase, Jr. | 317/123 |
| 3,683,239 | 8/1972 | Sturman | 317/150 |
| 3,693,122 | 9/1972 | Willard | 335/174 |
| 3,783,423 | 1/1974 | Mater et al. | 335/174 |
| 3,792,390 | 2/1974 | Boyd | 335/229 |
| 3,886,507 | 5/1975 | Johnston et al. | 335/234 |
| 3,944,957 | 3/1976 | Kotos et al. | 335/174 |
| 4,000,481 | 12/1976 | Pang | 335/170 |
| 4,013,926 | 3/1977 | Lang et al. | 361/115 |
| 4,129,843 | 12/1978 | Keller et al. | 335/174 |
| 4,172,241 | 10/1979 | Bosch et al. | 335/174 |
| 4,213,109 | 7/1980 | Marcoz | 335/174 |
| 4,229,775 | 10/1980 | Miller | 361/210 |
| 4,238,750 | 12/1980 | Smith | 335/173 |
| 4,251,789 | 2/1981 | Russell et al. | 335/174 |
| 4,288,771 | 9/1981 | Ueda et al. | 335/230 |
| 4,344,055 | 8/1982 | Toda et al. | 335/174 |
| 4,370,637 | 1/1983 | Siffroi | 335/174 |
| 4,399,421 | 8/1983 | MacLean | 335/174 |
| 4,599,590 | 7/1986 | Preuss et al. | 335/175 |
| 4,620,173 | 10/1986 | O'Brien | 335/205 |
| 4,641,117 | 2/1987 | Willard | 335/7 |
| 4,660,012 | 4/1987 | Bonniau et al. | 335/234 |
| 4,672,343 | 6/1987 | Kasahara | 335/170 |

FOREIGN PATENT DOCUMENTS 526637 3/1954 Belgium .

*Primary Examiner*—George Harris
*Attorney, Agent, or Firm*—James G. Morrow

[57] ABSTRACT

A magnetic actuating or trip mechanism for use with a circuit breaker including an armature, a permanent magnet for biasing the armature to a biased position, a first magnetic member having an armature guide, a second magnet member, an electromagnetic coil including a first winding for urging the armature from the biased position and a second winding for urging the armature from the biased position, a compression spring for urging the armature from the biased position, a fastener for fastening the first and second members to the permanent magnet, and recesses for locating the electromagnetic coil relative to the first and second members. The coil includes an armature opening and the first and second members each include a permanent magnet mounting surface and a coil mounting surface, the permanent magnet mounting surface includes a ridge for preventing the members from rotating relative to the permanent magnet.

12 Claims, 2 Drawing Sheets

MAGNETIC ACTUATING MECHANISM

BACKGROUND OF THE INVENTION

This invention relates to a magnetic actuating mechanism, and, more particularly, to an actuating mechanism including a permanent magnet and an electromagnet.

In many electromagnetic devices, such as relays and circuit breaker trip units, permanent magnets are used to maintain a movable element of the device in a biased position against the actuating force of a spring. The movable element is urged from the biased position when a electromagnetic flux opposing the magnetic flux of the permanent magnet is produced. The electromagnetic flux opposes the magnetic flux of the permanent magnet with sufficient strength to permit the spring to urge the movable element from the biased position. Examples of such devices are described in U.S. Pat. No. 3,783,423 issued Jan. 1, 1974 and U.S. Pat. No. 4,000,481 issued Dec. 28, 1976.

U.S. Pat. No. 4,000,481 describes a magnetic latch which is released by electromagnetic means. The armature and spring of the magnetic latch are held in a retracted position by the force of a magnetic flux field generated by permanent magnets. Energization of an electromagnet coil generates a magnetic flux in opposition to the permanent magnet flux whereby the force of the net flux acting on the armature is insufficient to maintain the armature and spring in the retracted position. Thus, the spring moves the armature to actuate a utilization device.

As with many other electronic components, one of the main goals in developing and improving magnetic actuators is to produce a physically smaller component that will perform as well or better than its larger predecessor. Another goal is to reduce the number of component parts that need to be handled and assembled in producing the component. In the electronic components industry, just a small step toward achieving these goals can mean increased profits and an increased market share. As can be seen in the preferred embodiment of the invention of U.S. Pat. No. 4,000,481, a considerable number of components are needed to construct the magnetic latch.

More specifically, where magnetic actuators are used in circuit breaking device, there is need to decrease the physical size of the magnetic actuators so that the size of circuit breaking devices can also be decreased by reducing the space in the circuit breaking device for the magnetic actuator.

One problem with prior art actuators, such as the latch described in U.S. Pat. No. 4,000,481, is the absence of a simple mechanism to trip the actuator mechanically.

SUMMARY OF THE INVENTION

It is an object of this invention to provide a compact magnetic actuating mechanism having a reduced number of component parts and requiring fewer assembly steps.

Additionally, it is an object of this invention to provide an actuating mechanism wherein the armature can be urged from a biased position by electromagnetic means or mechanical means.

Accordingly, there is provided a magnetic actuating mechanism including an armature, a permanent magnet for biasing the armature to a biased position, a first magnetic member defining an armature guide, a second magnetic member, an electromagnetic coil including a first winding for urging the armature from the biased position, wherein the coil defines an armature opening, means for urging the armature from the biased position, means for fastening the first and second members to the permanent magnet, and means for locating the electromagnetic coil relative to the first and second members.

DETAILED DESCRIPTION OF THE PREFERRED EMBODIMENT

Figure 1:
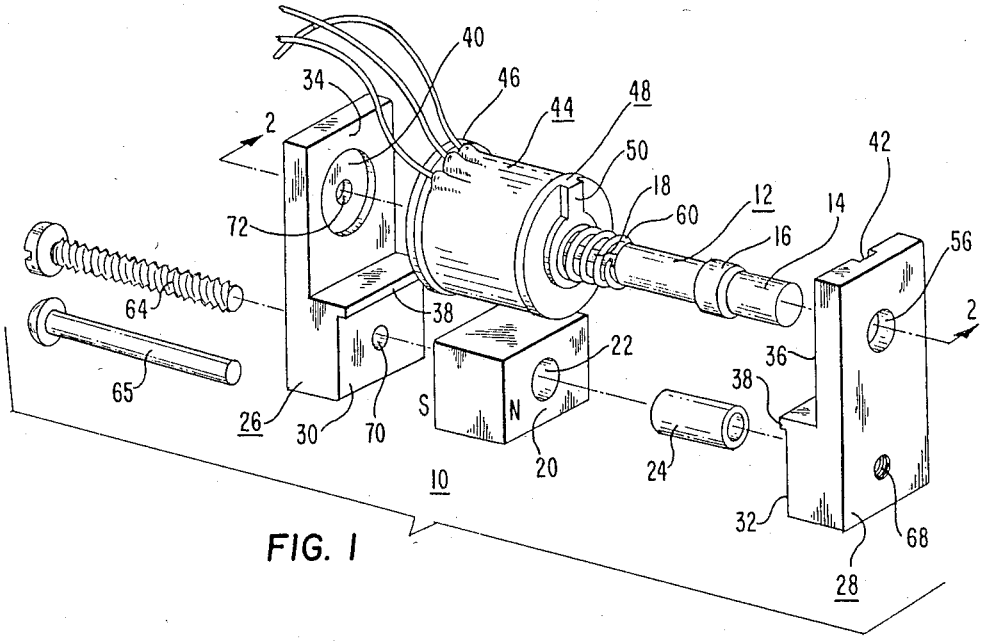
FIG. 1 is an exploded perspective view of the magnetic actuating mechanism.
Figure 2:
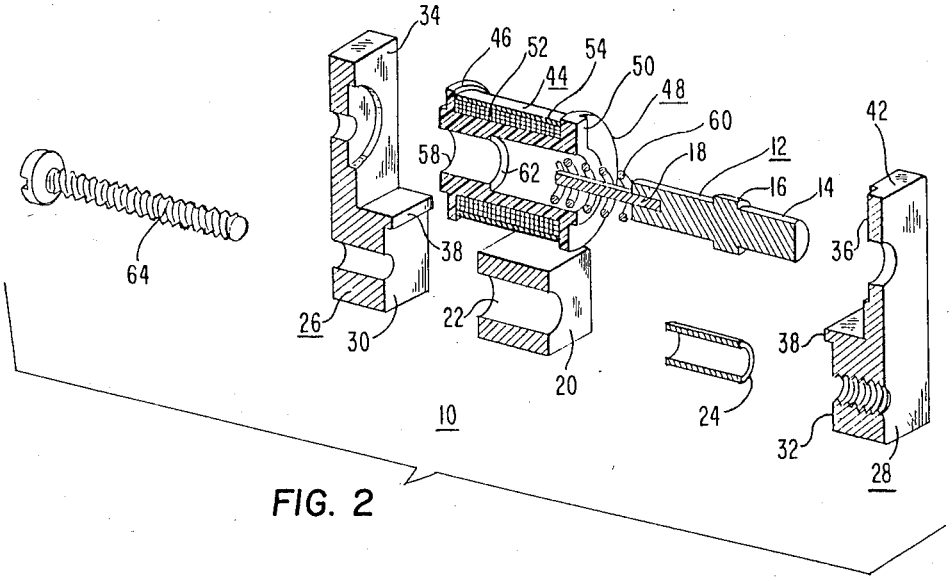
FIG. 2 is a cross-sectional view of the magnetic actuating mechanism taken along line 2—2 of FIG. 1.
Figure 3:
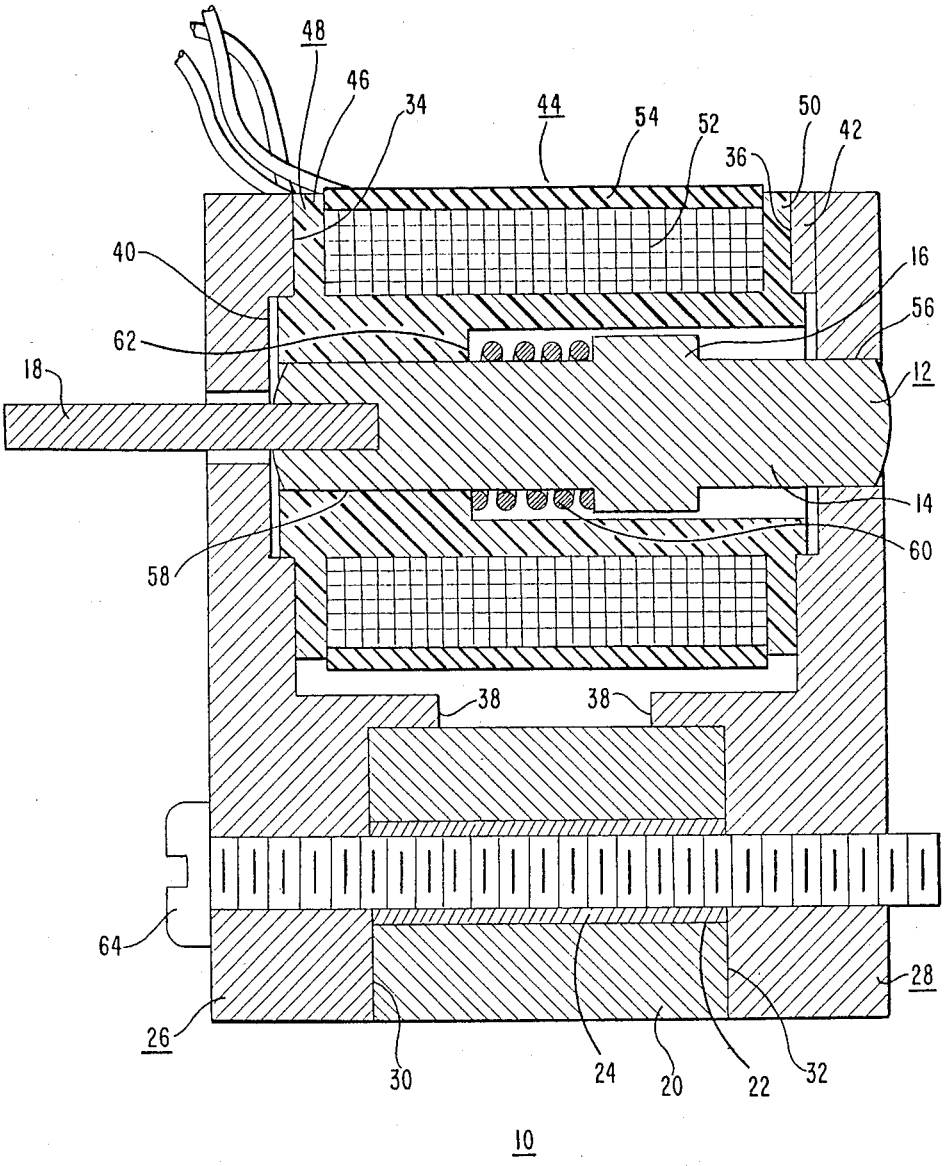
FIG. 3 is a cross-sectional view of the magnetic actuating mechanism.

Turning now to the drawings, FIGS. 1–3 illustrate the preferred embodiment of the magnetic actuating mechanism 10. The armature 12, as shown in FIGS. 1–3 includes a cylindrical body 14, a shoulder 16 and a mechanical actuating rod 18. The shoulder 16 is preferably a machined portion of the armature 12, but can take the form of a sleeve pressed onto the armature 12. The mechanical actuating rod 18 preferably is a brass rod pressed into one end of the armature 12.

The permanent magnet 20 has the form of a bar magnet and includes one mounting hole 22 formed through substantially the center of the magnet 20 along a line from the north pole (N) of the magnet 20 to the south pole (S) of the magnet 20. The hole is formed such that a spacer 24 can slide into the hole. The spacer 24 is preferably made of aluminum and functions to prevent the magnet 20 from being damaged during the assembly of the actuating mechanism 10.

The magnetic members 26 and 28 each include a permanent magnet mounting surface 30, 32 and a coil mounting surface 34, 36. Each permanent magnet mounting surface 30, 32 defines a ridge 38 for preventing the members 26, 28 from rotating relative to the permanent magnet 20. Each coil mounting surface 34, 36 includes a recess 40, 42 for mounting the electromagnet coil 44 between the magnetic members 34, 36. The first recess 40 is circular and is adapted to accept the shoulder section 46 of the coil bobbin 48. The second recess 42 has a modified circular shape including a vertical channel extending upwardly. As illustrated in FIG. 1, the bobbing 48 includes a mounting section 50 which is adapted to extend into the recess 42 and prevent the coil 44 from rotating relative to the magnetic members 34, 36. By way of example, the magnetic members 34, 36 can be machined from steel or produced via powder metallurgy.

The electromagnetic coil 44 includes the bobbin 48, a first winding 52 and a second winding 54. Preferably, the first winding 52 has approximately 6000 turns of wire and the second winding 54 has 40 turns of wire.

Referring now to FIG. 3, there is shown a cross-sectional view of the magnetic actuator wherein the armature 12 is in its biased position. One end of the armature is supported in the armature guide 56 of one of the magnetic members 28. The other end of the armature 12 is supported in the armature guide 58 of the bobbin. The armature guides 56, 58 support the armature 12 such that the armature is allowed to translate within the coil 44. A compression spring 60 serves as a means for urging the armature 12 from its biased position. One end of the spring 60 exerts its force against the shoulder 16 of the armature, while the other end of the spring 60 exerts its force against the shoulder 62 of the armature guide 58.

The means for fastening the first and second members 26, 28 to the permanent magnet can take the form of a threaded member 64 or rivet 66 passing through the spacer 24 and openings 68, 70 in the members 26, 28. As illustrated in FIG. 3, only one threaded member 64 or rivet 65 is needed to hold the whole actuator assembly together, therefore, assembly can take place with only one fastening operation. The means for fastening causes the members 26, 28 to fix or clamp the permanent magnet 20 and coil 44 between the members 26, 28.

When the magnetic actuator is assembled, as in FIG. 3, the permanent magnet 20 and coil 44 are mounted in a side-by-side relationship such that the longitudinal axis of the permanent magnet 20 is substantially parallel to the longitudinal axis of the coil 44. The permanent magnet 20 cooperates with the magnetic members 26, 28 such that the magnetic flux of the permanent magnet 20 holds the armature 12 in a biased position against the force of the spring 60.

The armature 12 of the magnetic actuator 10 can be moved from the biased position in at least three ways. Firstly, a force additive to the spring 60 force can be applied to the actuator rod 18 which passes through an opening 72 in the member 26. When these forces overcome the biasing forced caused by the permanent magnet 20 the spring 60 causes the armature to move into its unbiased or tripped position. Secondly, the first windings 52 can be energized to produce a magnetic flux opposed to that of the permanent magnet 20, thereby permitting the spring 60 to cause the armature 12 into its unbiased position. Preferably, the winding 52 is energized with approximately 25 milliamps at 25–40 volts. Thirdly, when the armature 12 is required to move into the unbiased position in a reduced amount of time, both the first and second windings 52, 54 can be energized. Preferably, the windings 52, 54 are energized with approximately 1.5 amps at 35–50 volts. The two sets of windings 52, 54 are not always used since the standard trip unit for use with the coil 44 is not designed to frequently supply a control current to the coil of 1.5 amps. Additionally, the armature 12 is not always required to move into the unbiased position in such a short amount of time.

The unbiased position of the armature 12 is also referred to as the tripped position since, in the tripped position, the armature extends beyond the magnetic member 28 to contact the trip bar of a circuit breaker and thereby trip the circuit breaker.

Wherein one embodiment of the invention various modifications have been shown and described, various other modifications intended to be included within the scope of this invention will become apparent from the preceding description to one skilled in the art.

We claim:

1. A magnetic actuating mechanism comprising:
- an armature;
- a permanent magnet for biasing the armature to a biased position;
- a first magnetic member defining an armature guide;
- a second magnetic member;
- an electromagnetic coil including a first winding for urging the armature from the biased position, wherein the coil defines an armature opening;
- means for urging the armature from the biased position;
- means for fastening the first and second members to the permanent magnet; and
- means for locating the electromagnetic coil relative to the first and second members in a side-by-side relationship to the permanent magnet.

2. The magnetic actuating mechanism of claim 1, wherein the electromagnetic coil further includes a second winding for urging the armature from the biased position.

3. The magnetic actuating mechanism of claim 2, wherein the first and second members each include a permanent magnet mounting surface and a coil mounting surface, the permanent magnet mounting surface defining a ridge for preventing the members from rotating relative to the permanent magnet.

4. The magnetic actuating mechanism of claim 3, wherein the means for urging the armature from the biased position is a compression spring.

5. The magnetic actuating device of claim 4, wherein the means for fastening the first and second members to the permanent magnet is a threaded fastener.

6. The magnetic actuating mechanism of claim 4, wherein the means for fastening the first and second members to the permanent magnet is a rivet.

7. The magnetic actuating mechanism of claim 4, wherein the armature includes a mechanical actuating rod and the second magnetic member defines an actuating rod guide.

8. A magnetic trip mechanism for a circuit breaker comprising:
- an armature;
- a permanent magnet for biasing the armature to a biased position;
- a first magnetic member defining an armature guide;
- a second magnetic member;
- an electromagnetic coil including a first winding for urging the armature from the biased position and a second winding for urging the armature from the biased position, wherein the coil defines an armature opening and the first and second members each include a permanent magnet mounting surface and a coil mounting surface, the permanent magnet mounting surface defining a ridge for preventing the members from rotating relative to the permanent magnet;
- a compression spring for urging the armature from the biased position;
- means for fastening the first and second members to the permanent magnet; and
- means for locating the electromagnetic coil relative to the first and second members in a side-by-side relationship to the permanent magnet.

9. The magnetic actuating mechanism of claim 8, wherein the means for fastening the first and second members to the permanent magnet is a threaded fastener.

10. The magnetic actuating mechanism of claim 8, wherein the means for fastening the first and second members to the permanent magnet is a rivet.

11. The magnetic actuating mechanism of claim 8, wherein the armature includes a mechanical actuating rod and the second magnetic member defines an actuating rod guide.

12. The magnetic actuating mechanism of claim 11, wherein each coil mounting surface includes a recess adapted to accept one end of the coil.

* * * * *